United States Patent [19]

Cros

[11] Patent Number: 4,534,203

[45] Date of Patent: Aug. 13, 1985

[54] ADAPTER DEVICE FOR MOUNTING PUNCHES ON A BENDING PRESS

[75] Inventor: Pierre Cros, Vaucresson, France

[73] Assignee: Promecam Sisson-Lehmann, Saint Denis, France

[21] Appl. No.: 573,501

[22] Filed: Jan. 24, 1984

[30] Foreign Application Priority Data

Feb. 15, 1983 [FR] France ..... 83 02386

[51] Int. Cl.[3] ..... B21D 37/04

[52] U.S. Cl. ..... 72/481; 72/389

[58] Field of Search ..... 72/389, 413, 473, 481; 83/698; 403/341, 373, 312, 3

[56] References Cited

U.S. PATENT DOCUMENTS 4,315,425 2/1982 Zbornik et al. ..... 72/389

FOREIGN PATENT DOCUMENTS 2355867 5/1975 Fed. Rep. of Germany ..... 72/481

42354 4/1979 Japan ..... 72/481

*Primary Examiner*—Lowell A. Larson

*Assistant Examiner*—Robert L. Showalter

*Attorney, Agent, or Firm*—Young & Thompson

[57] ABSTRACT

Punches having attachment heels of different types are mounted on a bending press by means of an adapter consisting of a bar or a series of bar segments secured to the top die-shoe of the press. The bottom portion of the adapter body is provided in one vertical face with a recess of greater depth than any type of punch attachment heel. A bearing spacer having the same height as the adapter body recess is placed against the punch heel either at the bottom of the recess or in an external position. The spacer and heel of the corresponding punch are held in position by a cramp which is tightly applied against the adapter body on the same side as the recess opening.

4 Claims, 7 Drawing Figures

8
8
8
9
9
9
9
11
11
14
14
14
14
15
15
15
X
2
7
6
10
1
13
12
5
4
3
Y 2
10
1c
6
11
15
12c
14
4
13c
19
3
20
17
4a
3a
5a
5b
4b
3b

ADAPTER DEVICE FOR MOUNTING PUNCHES ON A BENDING PRESS

This invention relates to devices employed for mounting bending punches on a bending press.

As a general rule, these punches are fixed on the bottom edge of the upper platen or top die-shoe of a bending press and in a position opposite to a V-shaped die which is fixed on the top edge of the lower platen or bottom die-shoe. These punches and dies are fixed in position in a removable manner in order to permit replacement by other punches and dies having different profiles according to the thicknesses of metal sheets and the nature of the bends to be formed in a metal sheet.

For the purpose of mounting in position, punches are provided with an attachment heel which is intended to be engaged within a recess formed in the edge of the top die-shoe and to be fixed in position within the recess by means of a predetermined number of cramps arranged at intervals in the lengthwise direction.

However, the cross-section of the attachment heel thus provided has shapes which vary according to the types of bending press produced by different manufacturers. Three types of attachment heels may thus be distinguished as follows:

(a) offset heels located on one side of the corresponding punches in order to free a bearing zone located in the axis of the bending thrust;

(b) central heels located in a center position between two lateral bearing zones which are symmetrical with respect to the axis of the bending thrust;

(c) heels which are also placed at the center but have a bearing zone located on the top face of the heel and in the axis of the bending thrust.

Since each press manufacturer has adopted one of these different types of attachment heel, the recess provided in the bottom edge of the top die-shoe of all presses produced by that manufacturer has a cross-section which is adapted solely to the particular type selected. In the case of a press of a given make, it is consequently not possible to mount punches initially designed for presses produced by other manufacturers who have adopted an attachment heel of a different type. Users who are equipped (or who desire to be equipped) with presses of different makes thus suffer a disadvantage. Indeed they have no means of exchanging the punches of these presses or of providing a single set of punches which can be adapted with equal ease to any one of the different presses existing in the same workshop.

In order to overcome this drawback, it has already been proposed to provide adapter devices so designed as to be mounted on a press of any given make and to receive punches having attachment heels corresponding to a type of punch which is not the same as those normally provided for that particular press. It proves necessary in such a case, however, to produce an adapter device for each type of attachment heel. Furthermore, when an adapter of this kind is in position and when it is desired to mount a punch having an attachment heel of a different type, this adapter has to be removed and replaced by another adapter corresponding to this new type of attachment heel. It is therefore impossible to changeover from one type to another without involving a certain number of operations which require a long time to perform.

It is for these reasons that the present invention is directed to an adapter which is so designed as to remain permanently fixed on the upper platen or top die-shoe of a bending press in order to receive punches having attachment heels of different types including those of the type provided for the corresponding press.

To this end, the aforementioned adapter is constituted by the following combination:

a body in the form of a bar or of bar segments which can be attached to the top die-shoe of the corresponding press and the bottom portion of which is provided on one of its vertical faces with a recess of greater depth than the attachment heel of a punch, irrespective of the type of said heel;

a bearing spacer having the same height as the recess of the adapter body and capable of being placed against the heel of the punch to be fixed in position, either in the bottom portion of the recess of the adapter body or in the external position;

said spacer and the heel of the corresponding punch being fixed in position by means of cramps which are applied against the adapter body by means of threaded bolts and located on the same side as the opening of the recess provided in said adapter body.

Thus the adapter in accordance with the invention makes it possible to mount on the top die-shoe of a bending press of any given make punches having attachment heels which may or may not correspond to the type originally designed for said press. Accordingly, it is only necessary to change the position of the bearing spacer fitted within the recess of the adapter body in order to achieve suitable re-location of the housing provided for the attachment heel of the punch to be mounted in position.

These and other features of the invention will be more apparent upon consideration of the following description and accompanying drawings, wherein.

Figure 1:
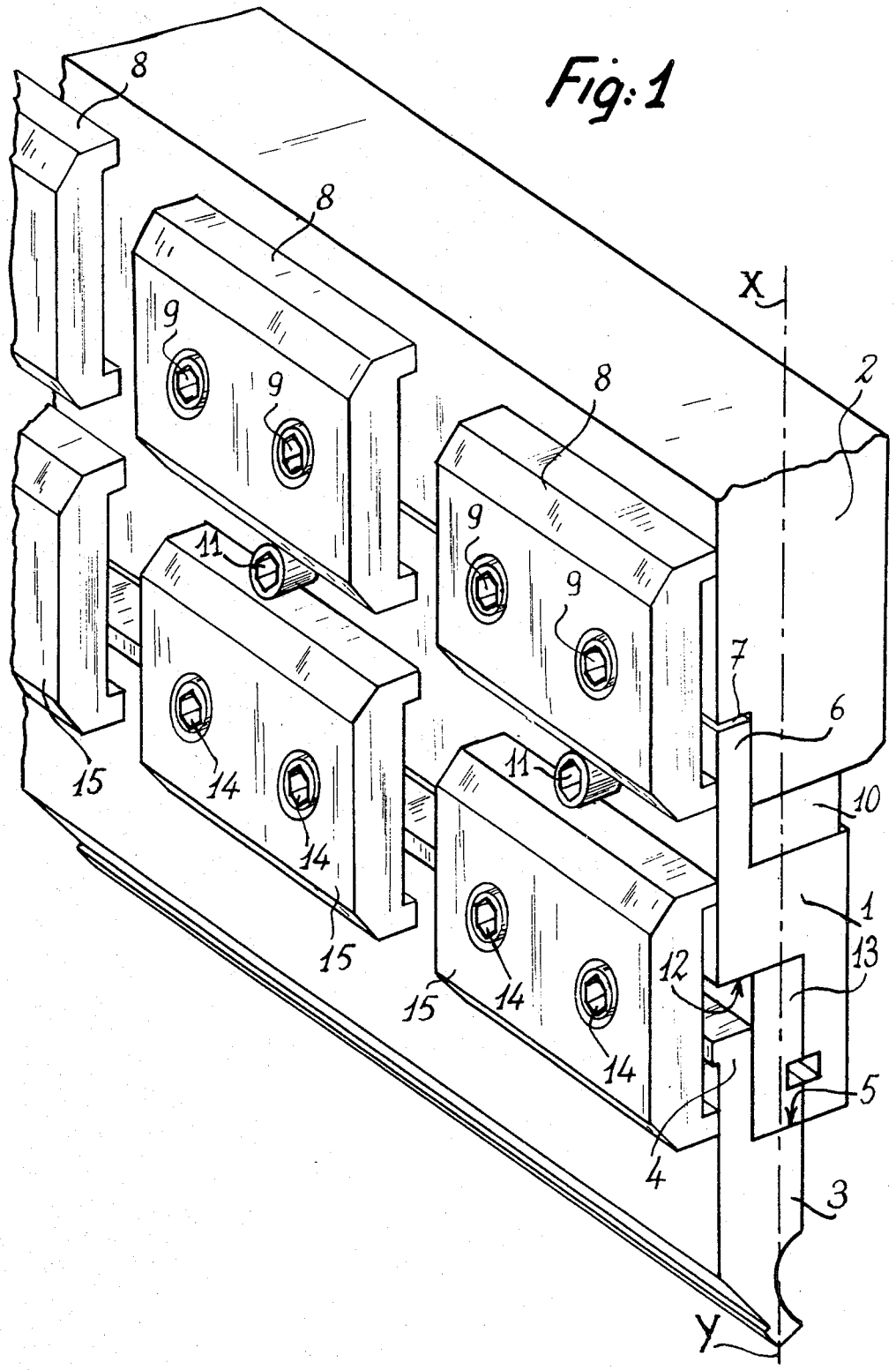
FIG. 1 is a partial view in perspective of an adapter in accordance with the invention which is secured to the top die-shoe of a bending press, and of a punch which is mounted in position by means of said adapter.

As already mentioned, the body of the adapter in accordance with the invention is designed in the form of a bar 1 which extends over the entire length of the bottom edge of the upper platen 2 or top die-shoe 2 of a bending press. However, the adapter body could also be constituted by a series of bar segments arranged in series, with or without relative spacing, over the entire length of the edge of the top die-shoe 2 of a bending press.

The adapter bar may either be formed in one piece or consist of a series of successive segments and is intended to be permanently fixed on the edge of the top die-shoe 2 of a bending press of any given make. Thus in the example shown in FIG. 1, the bar is intended to be mounted on a press designed to receive punches 3 which are provided in each case with an attachment heel 4. Said heel is of the so-called offset type or, in other words, is displaced to one side and has a bearing face 5 located in the axis X-Y of the bending thrust. In consequence, the top face of the adapter bar in turn carries a heel block 6 which is located on one side and is intended to be placed within the lateral recess 7 formed in the bottom edge of the top die-shoe 2 of the corresponding press, usually for the purpose of accommodating the heels 4 of the punches 3 provided for this press. The heel block 6 of the adapter bar 1 is then fixed within said recess in the conventional manner, that is to say by means of a series of clamping plates or so-called cramps 8 which are placed at intervals along the entire length and secured to the edge of the top die-shoe 2 by means of screws 9.

Figure 4:
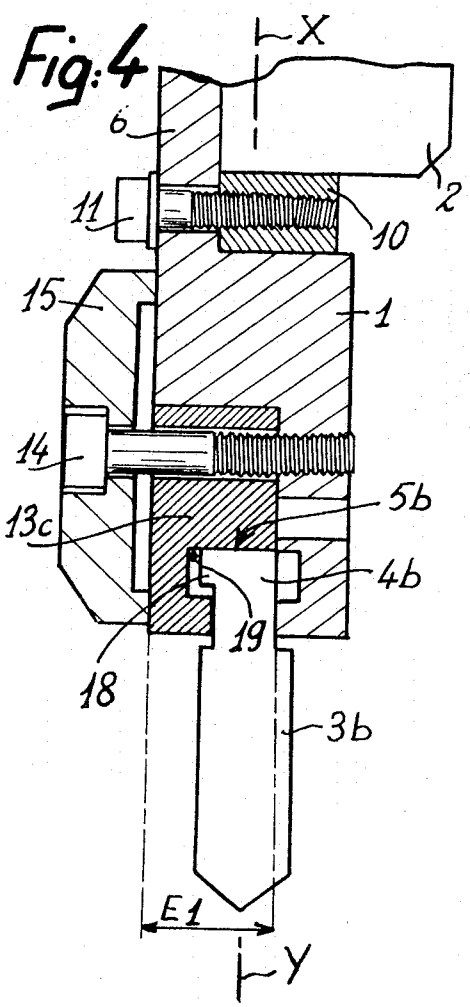
FIGS. 2, 3 and 4 are vertical sectional views of the same adapter and representing modes of assembly of punches provided with attachment heels of different types.
Figure 3:
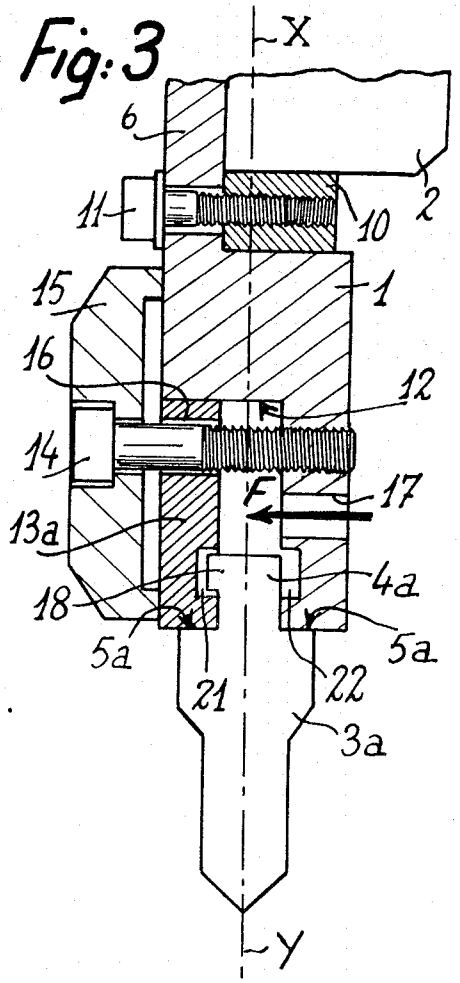

However, the shape of the attachment heel block 6 carried by the adapter bar 1 is different if the adapter under consideration is intended to be secured to the top die-shoe of a press designed to receive punches having attachment heels of different types such as, for example:

- a punch 3*a* having an attachment heel 4*a* located at the center and provided on each side with a lateral bearing face 5*a*, these two bearing faces being symmetrical with respect to the axis X-Y of bending thrust (as shown in FIG. 3);
- or a punch 3*b* having an attachment heel 4*b* located at the center and provided with a bearing zone 5*b* which is located above said heel and in the bending axis X-Y (as shown in FIG. 4).

One of the three possible types of attachment heels of the bar 1 of the adapter under consideration has therefore been shown solely by way of example in FIG. 1. The shape and arrangement of this attachment heel can in fact vary according to the type of press on which the adapter in accordance with the invention is to be fixed.

Provision is made for a series of packing-pieces 10 having a slightly trapezoidal cross-section, said packing-pieces being interposed between the top face of the adapter bar 1 and the underface of the top die-shoe 2 of the press and held in position by means of screws 11. It is therefore only necessary to slacken the screws in order to displace the packing-pieces and to carry out a very accurate positional adjustment of the bearing faces 5 with respect to the top die-shoe 2. However, the presence of these packing-pieces is optional.

In accordance with one of the essential features of the adapter under consideration, the bar 1 which constitutes the adapter body is provided in its underface with a recess 12 which is open on one face of the bar, that is to say usually the bar face which is to be placed on the front side of the press. The depth E of this recess is distinctly greater than the thickness of the attachment heel 4, 4*a* and 4*b* of the three types of punches which are intended to be mounted on the adapter in accordance with the invention.

In conjunction with the adapter body, provision is made for a bearing spacer 13, the height of which is equal to that of the recess 12 and the thickness of which corresponds substantially to the difference between the depth E of said recess and the thickness of the various types of heels 4, 4*a* and 4*b* of the different punches to be mounted on the adapter.

The aforementioned bearing spacer 13 can thus be placed against the heel of the punch to be fixed in position and within the interior of the recess 12, either at the bottom of this latter or in the external position. The spacer 13 thus permits suitable conversion of the housing location provided for the attachment heel of the punch to be mounted in position.

Said bearing spacer member is held in position by the screws 14 which are provided for clamping a series of cramps 15 arranged at intervals over the entire length of the adapter in accordance with the invention. In fact, before being screwed into the bar 1, the ends of said screws are engaged through bores 16 which extend right through the bearing spacer member 13. This member can thus be displaced in the transverse direction by sliding over the clamping bolts 14.

Figure 2:
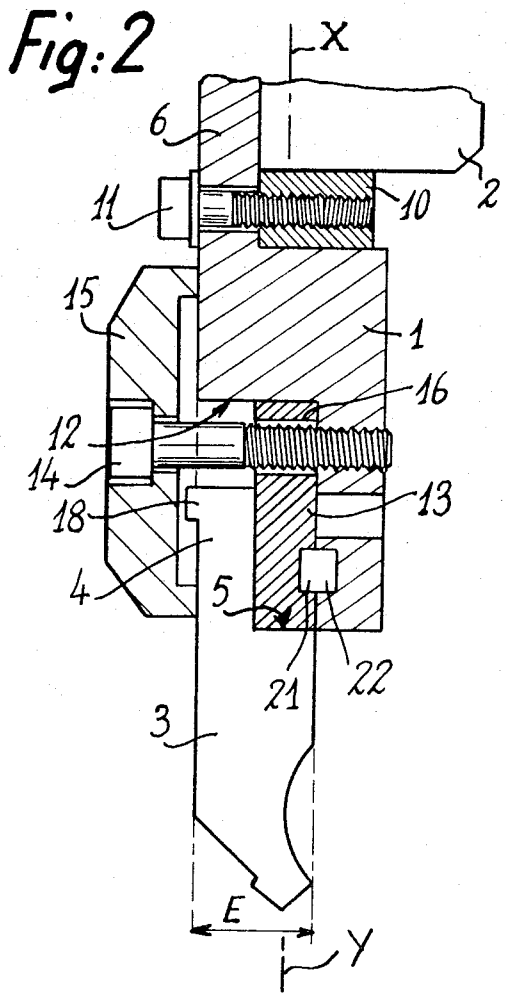

FIG. 2 illustrates the case in which the adapter in accordance with the invention is employed for mounting on the top die-shoe 2 of the bending press a punch 3 having an attachment heel 4 of the offset type, that is to say which is displaced to one side. In this case, the bearing spacer 13 is placed in the bottom of the recess 12, with the result that the bearing face 5 of the punch 3 is applied against the underface of the spacer. Under these conditions, the spacer serves as an intermediate member for transmission of thrust between the punch 3 and the adapter body 1.

However, in order to provide the possibility of mounting a punch 3*a* with an attachment head 4*a* located at the center and having two bearing faces 5*a* located on each side, the bearing spacer 13 need only be displaced in the outward direction in order to be thenceforth located in the position 13*a* shown in FIG. 3. This in fact makes it possible to leave a free space between the bottom of the recess 12 and said bearing spacer, with the result that the central heel 4*a* for the attachment of the punch 3*a* can be engaged within the free space thus provided.

A point worthy of note is that this operation is clearly performed without any need for disassembly of the adapter body 1. There is not even any need to disassemble the bearing spacer member since it is only necessary to slide this latter in the transverse direction over the clamping screws 14. In order to facilitate this operation, the bottom portion of the adapter bar 1 can advantageously be provided with a series of holes 17 which are spaced at intervals over its entire length and serve to engage a tool within the recess 12 in order to exert a thrust in the direction of the arrow F and push back the bearing spacer 13 in the outward direction.

In order to replace a punch of type 3 by a punch of type 3*a*, it is therefore only necessary in the final analysis to displace the bearing spacer 13 after having slackened the cramps 15. Preferably, the attachment heels 4, 4*a* and 4*b* of the different punches are provided with a retaining lug 18 for preventing any accidental falling of the punches at the time of slackening of the cramps 15. Depending on the type of punch, said retaining lug 18 is arrested either by the cramp 15 or by the recesses 21 or 22.

FIG. 4 shows the arrangement of a punch 3*b* having a central heel 4*b* with a top bearing face 5*b*. It is clear in this case that the adapter body always remains attached to the top die-shoe 2 of the bending press. But it is necessary to remove the bearing member 13 and to replace it by another bearing member 13*c* having a thickness E1 corresponding to the depth of the recess 12 of the adapter bar 1. It will be noted that the lower portion of this bearing member 13*c* in turn has a recess 19 which is open on the side opposite to the front face and is intended to receive the attachment heel 4*b* of the punch 3*b*. Thus the top face of said recess 19 is placed in position against the bearing face 5*b* of said heel in order that the bearing spacer 13*c* should again serve as an intermediate member between the punch and the adapter body 1 in order to transmit the bending thrust.

As will readily be understood, it is necessary to carry out replacement of the movable bearing member 13 by another bearing member 13*c* in the event that it may be desired to mount a punch of type 3*b*. Such a replacement, however, is clearly unnecessary when the presses owned by the user are designed only for punches of types 3 and 3*a*.

Figures 5, 6, 7:
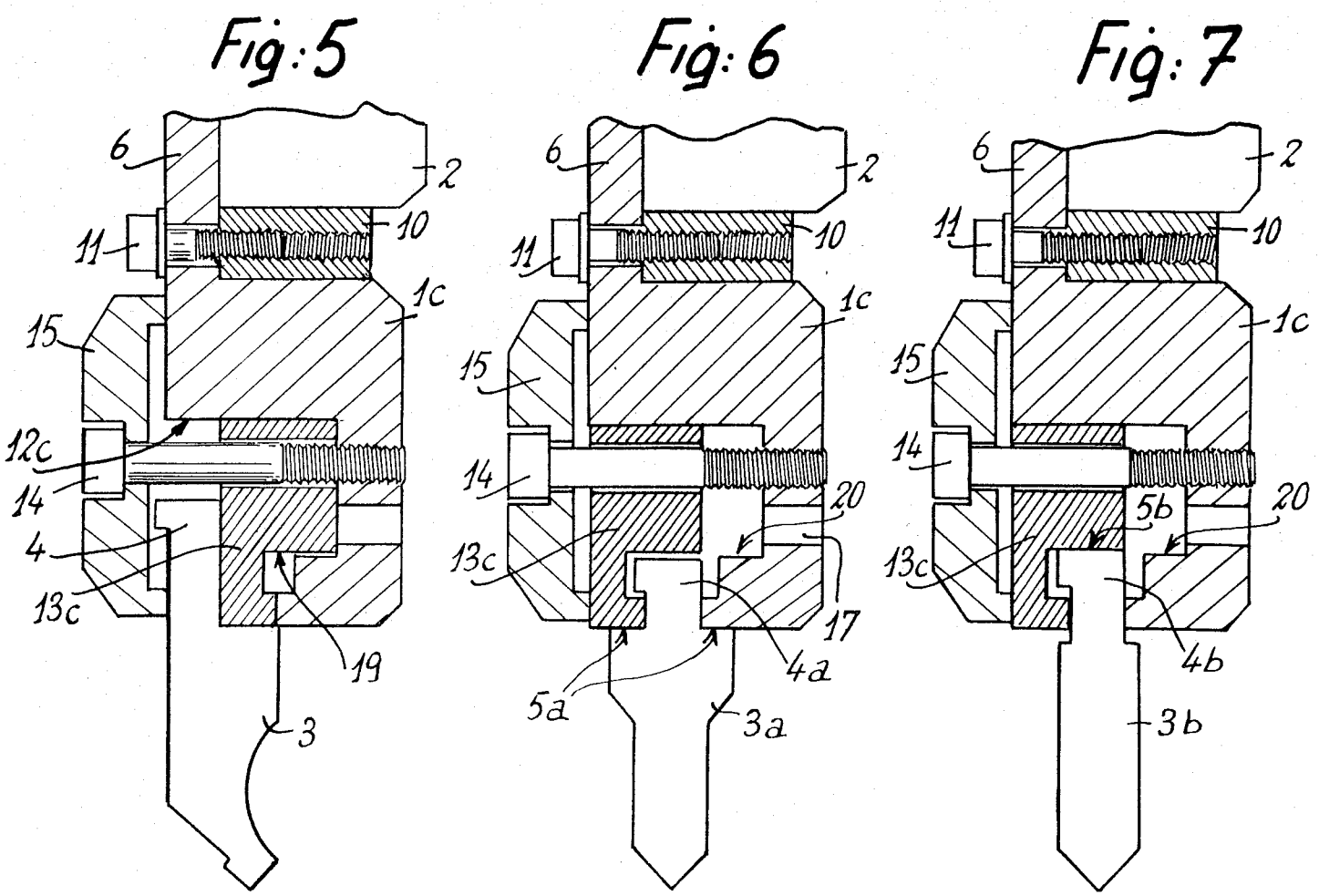
FIGS. 5, 6 and 7 are views which show another embodiment of the adapter in accordance with the invention and which illustrate modes of assembly of punches provided with attachment heels of different types.

However, FIGS. 5 to 7 illustrate another embodiment of the adapter in accordance with the invention which is so designed as to permit assembly of punches of the three types referred-to above without any need to change the bearing member placed within the recess of the adapter body.

In this case the bearing member thus provided is of the same type as the member 13*c* which has already been shown in FIG. 4. However, the recess 12*c* formed within the body 1*c* of the corresponding adapter is provided in this instance with a bottom channel 20. This channel is intended to receive if necessary the projecting portion of the bearing member 13*c*, said projecting portion being located above its recess 19. It will be apparent in this case that the adapter body 1*c* which can once again be constituted by a one-piece bar or a series of bar segments placed in succession has a greater thickness than the adapter body 1 shown in FIGS. 1 to 4.

FIG. 5 illustrates the mode of assembly of a punch 3 having an attachment heel 4 of the offset type. As in the case illustrated in FIG. 2, the bearing member 13*c* is placed in this case within the bottom of the recess 12*c* of the adapter bar 1*c*.

Referring now to FIG. 6, this figure illustrates the assembly of a punch 3*a* provided with an attachment heel 4*a* which is located at the center and on each side of which are formed lateral bearing faces 5*a*. As in the case illustrated in FIG. 3, the movable bearing spacer 13*c* is accordingly placed in the external position.

Finally, FIG. 7 illustrates the mode of assembly of a punch 3*b* in which the attachment heel 4*b* is located at the center and has a top bearing face 5*b*.

In this last case, the movable bearing spacer 13*c* remains in the external position. But the top bearing face 5*b* of the punch 3*b* is now in contact with the bottom of the recess 19 provided within said bearing spacer, in the same manner as in the case illustrated in FIG. 4.

The adapter shown in FIGS. 5 to 7 therefore makes it possible to mount any one of the three types of punches 3, 3*a* and 3*b* considered in the foregoing. It will be understood that, both in this embodiment and in the embodiment of FIGS. 1 to 4, the punches of any one of these types can have any desired cross-section according to the bending operation to be performed.

It should also be pointed out that the body of the adapter in accordance with the invention can consist of a bar designed as a single unit or as a series of bar segments arranged in succession with or without a spatial interval between segments. Similarly, the movable bearing spacers 13 or 13*c* may also consist of a continuous member or of a series of separate elements arranged in succession. In the case just mentioned, each element can be associated with a cramp 15 and can be supported by the two clamping screws 14 of the cramp considered.

As stated in the foregoing, the adapter in accordance with the invention has the advantage of enabling the user of a press of any given make to mount on the press, not only punches specially designed for that press, but also punches designed for bending presses of different makes without entailing the need to disassemble the adapter.

What is claimed is:

1. An adapter for mounting punches having attachment heels on the top die-shoe of a bending press, wherein said adapter is constituted by the following combination:

a body in the form of bar means which can be attached to the top die-shoe of the corresponding press and the bottom portion of which is provided on one of its vertical faces with a recess of greater depth in a horizontal direction than an attachment heel of a punch, irrespective to the type of said heel;

a bearing spacer having the same height as the recess of the adapter body and capable of being placed against either vertical side of the heel of the punch to be fixed in position in the recess;

said spacer and the heel of the corresponding punch being fixed in position in the recess by cramps which are held by screws against the adapter body and are located on the same side in a horizontal direction as the opening of the recess provided in said body;

said screws passing through said spacer, and said spacer being slidable on the screws in a direction lengthwise of the screws until the screws are tightened to fix the spacer in position.

2. An adapter according to claim 1, wherein the thickness of the spacer corresponds approximately to the difference between the depth of the recess of the adapter body and the thickness of the attachment heel of the punches to be mounted in position.

3. An adapter according to claim 1, wherein the thickness of the spacer corresponds approximately to the depth of the recess of said adapter body but said bearing spacer in turn has a recess which opens in the opposite horizontal direction from the adapter body recess, the bottom of the adapter body recess being provided with a channel which is capable of receiving a projecting portion of said bearing spacer.

4. An adapter according to claim 1, wherein the lower portion of the adapter body is provided with a series of holes so that a thrust-exerting tool can be engaged within the adapter body recess in order to thrust the bearing spacer outwards.

* * * * *